US007391289B2

(12) United States Patent
McCoy et al.

(10) Patent No.: US 7,391,289 B2
(45) Date of Patent: Jun. 24, 2008

(54) SYSTEMS, METHODS, AND DEVICE FOR ACTUATING A CIRCUIT BREAKER

(75) Inventors: Brian Timothy McCoy, Duluth, GA (US); Thomas William Holland, Flowery Branch, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 177 days.

(21) Appl. No.: 11/194,808

(22) Filed: Aug. 1, 2005

(65) Prior Publication Data

US 2006/0028307 A1 Feb. 9, 2006

Related U.S. Application Data

(60) Provisional application No. 60/598,552, filed on Aug. 3, 2004.

(51) Int. Cl.

| | |
|---|---|
| ***H01H 75/12*** | (2006.01) |
| ***H01H 77/00*** | (2006.01) |
| ***H01H 81/00*** | (2006.01) |
| ***H01H 83/00*** | (2006.01) |

(52) U.S. Cl. ..... 335/35; 335/6; 335/16; 335/23; 335/165; 335/24; 335/25; 335/36; 335/37; 335/38; 335/39; 335/40; 335/41; 335/42

(58) Field of Classification Search ..... 335/6, 335/16, 23–25, 35–42, 165–176, 202; 218/22
See application file for complete search history.

(56) References Cited

U.S. PATENT DOCUMENTS

| | | | | |
|---|---|---|---|---|
| 2,320,437 | A * | 6/1943 | Jennings | 335/37 |
| 2,689,893 | A * | 9/1954 | Bodenschatz | 335/37 |
| 3,244,837 | A | 4/1966 | Strobel | |
| 4,231,006 | A | 10/1980 | Belttary | |
| 4,719,438 | A | 1/1988 | Mrenna | |
| 4,868,529 | A * | 9/1989 | Holland | 335/42 |
| 5,214,402 | A * | 5/1993 | DiVincenzo et al. | 335/167 |
| 5,373,272 | A * | 12/1994 | Scheel et al. | 335/16 |
| 5,430,419 | A * | 7/1995 | Scheel et al. | 335/16 |
| 5,453,723 | A * | 9/1995 | Fello et al. | 335/18 |
| 5,483,211 | A * | 1/1996 | Carrodus et al. | 335/18 |
| 5,510,759 | A * | 4/1996 | Gula et al. | 335/18 |
| 5,565,827 | A * | 10/1996 | Gula et al. | 335/16 |
| 5,608,367 | A | 3/1997 | Zoller | |
| 5,680,081 | A * | 10/1997 | Scheel et al. | 335/16 |
| 6,255,925 | B1 * | 7/2001 | DiMarco et al. | 335/176 |
| 6,396,370 | B2 | 5/2002 | Leone | |
| 6,747,534 | B1 * | 6/2004 | Mueller et al. | 335/38 |
| 6,943,652 | B2 * | 9/2005 | Rodriguez et al. | 335/6 |
| 2003/0206092 | A1 * | 11/2003 | Rodriguez et al. | 337/79 |
| 2004/0066260 | A1 * | 4/2004 | Rodriguez et al. | 335/172 |

FOREIGN PATENT DOCUMENTS

| | | |
|---|---|---|
| EP | 0548730 A2 | 6/1993 |
| EP | 0691668 A1 | 1/1996 |
| EP | 0923101 A2 | 6/1999 |
| FR | 1272438 | 9/1961 |

* cited by examiner

*Primary Examiner*—Elvin Enad
*Assistant Examiner*—Mohamad A Musleh

(57) ABSTRACT

Certain exemplary embodiments comprise a device comprising: a trip mechanism adapted to engage an operating mechanism of an alternating current circuit breaker, said trip mechanism comprising: a bi-metal element arranged lengthwise into a first end zone, a central zone, and a second end zone, a load bus coupled to said first zone, said second end zone adapted to engage an armature latch that is adapted to trip on operating mechanism of the circuit breaker; and an electromagnetic element coupled to the load bus.

20 Claims, 5 Drawing Sheets

SYSTEMS, METHODS, AND DEVICE FOR ACTUATING A CIRCUIT BREAKER

CROSS-REFERENCE TO RELATED APPLICATIONS

This application claims priority to pending U.S. Provisional Patent Application Ser. No. 60/598,552, filed 3 Aug. 2004.

BACKGROUND

U.S. Pat. No. 6,396,370 (Leone), which is incorporated by reference herein in its entirety, allegedly recites that "[t]he circuit breaker (10) of the present invention is a molded case circuit breaker and includes a molded case (12) having a main cover (20), a first terminal (16) and a second terminal (16) mounted inside the case (12) with a stationary contact (44) electrically coupled to the first terminal (18) and a movable contact (42) electrically coupled to the second terminal (16). The movable contact (42) is coupled to an operating mechanism (40) which has a pivoting member (13) moveable between an ON position, an OFF position and a TRIPPED position. An intermediate latching mechanism (52) also is mounted in the housing (12) and is coupled to the operating mechanism (40). The intermediate latching mechanism (52) is selectively operated by a trip unit (60) which comprises a magnetic short circuit release and a thermal overload release. The trip unit (60) can be reconfigured by the addition of an inner yoke (67) nested between the flanges (71) of an outer yoke (66) and a second magnetic shield (70) can be attached to the outer yoke (66) to change the sensitivity of the trip unit (60) to the currents experienced by the circuit breaker. A particular embodiment of the circuit breaker (10) includes an interchangeable bi-metal (62) member of a copper alloy having a chemical composition of CDA #19400 and with an electrical conductivity of not more than 40% IACS." See Abstract.

U.S. Pat. No. 5,608,367 (Zoller), which is incorporated by reference herein in its entirety, allegedly recites that "[i]n a molded case circuit breaker with an interchangeable thermal-magnetic trip unit, the C-shaped heater transformer core is permanently held in place in the casing by a load bus strap with the gap in the core facing the trip unit. When the interchangeable trip unit is inserted into the molded casing, a magnetically permeable member mounted in the trip unit is aligned in the gap in the heater transformer core. The bi-metal of the trip unit is fixed at one end to an electrically conductive sleeve surrounding the magnetically permeable member and forming the secondary of the heater transformer. The length of the magnetically permeable member is selected to establish the current conditions at which the bi-metal trips the circuit breaker. The bus strap has an off-set section forming a first shoulder against which one wall of the housing of the interchangeable trip unit seats, and a second shoulder against which a pole piece backed by the heater transformer core seats to fix a gap between the pole piece and the armature in the interchangeable trip unit providing the instantaneous magnetic trip function." See Abstract.

U.S. Pat. No. 4,719,438 (Mrenna), which is incorporated by reference herein in its entirety, allegedly recites a "circuit breaker structure having a faster trip unit characterized by a circuit breaker operator and a trip unit comprising a coil, a core, and an armature, a flux concentrating plate spaced from and on the side of the armature opposite the core and for concentrating the magnetic field between the core and the armature, and a hold-back bracket having extending from and retaining the armature in a spaced position from the core so as to cause the magnetic field lines to flow through the bracket-and the armature." See Abstract.

SUMMARY

Certain exemplary embodiments comprise a device comprising: a trip mechanism adapted to engage an operating mechanism of an alternating current circuit breaker, said trip mechanism comprising: a bi-metal element arranged lengthwise into a first end zone, a central zone, and a second end zone, a load bus coupled to said first zone, said second end zone adapted to engage an armature latch that is adapted to trip on operating mechanism of the circuit breaker; and an electromagnetic element coupled to the load bus.

BRIEF DESCRIPTION OF THE DRAWINGS

A wide variety of potential embodiments will be more readily understood through the following detailed description of certain exemplary embodiments, with reference to the accompanying exemplary drawings in which.

DEFINITIONS

Figure 1:
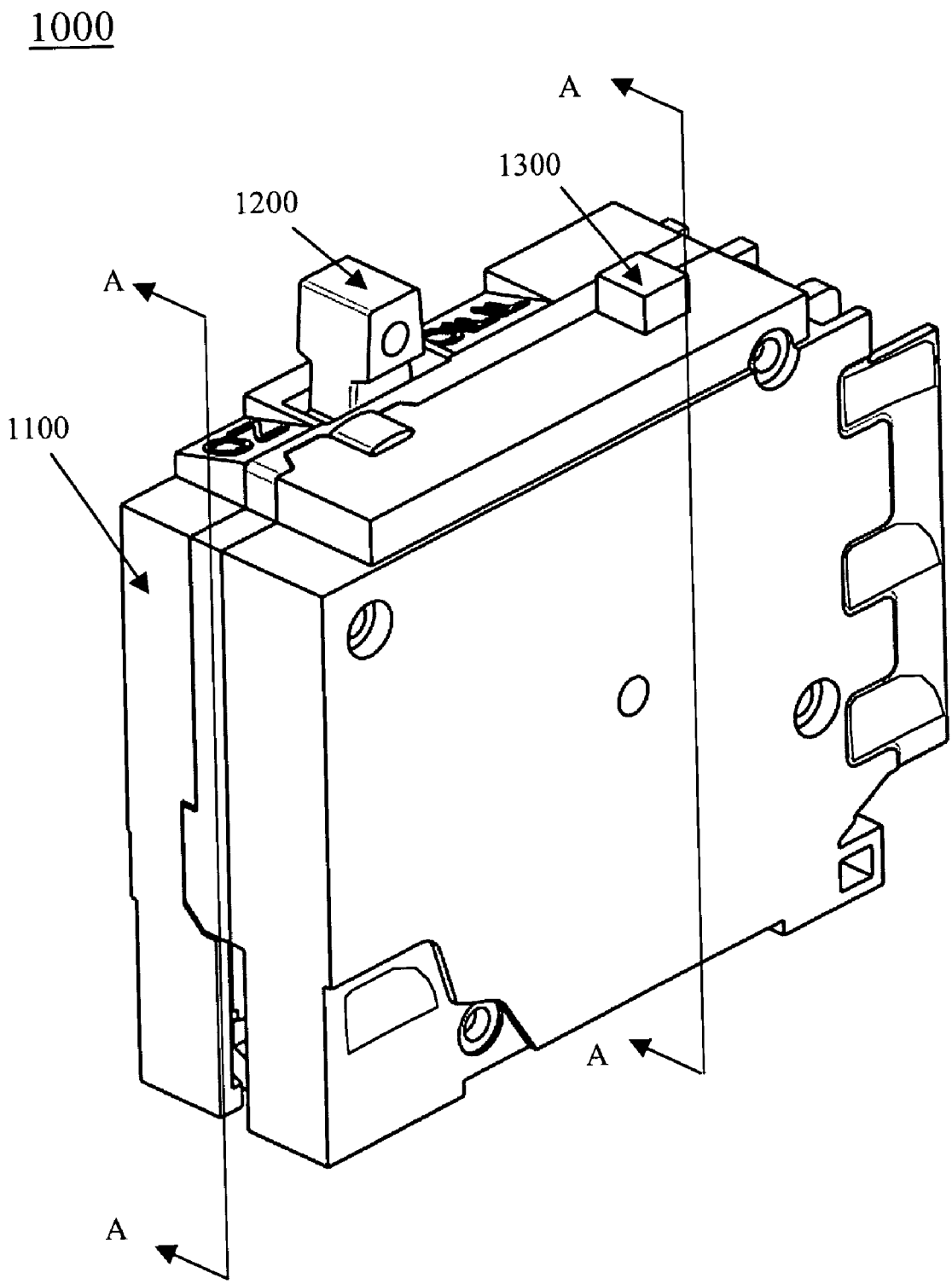
FIG. 1 is a perspective view of an exemplary embodiment of a system 1000.

When the following terms are used substantively herein, the accompanying definitions apply:

a—at least one.

actuate—to put into motion or action; activate.

adapted to—made suitable or fit for a specific use or situation.

adjacent—next to and/or adjoining.

alternating current—an electric current that reverses direction in a circuit at regular intervals.

apparatus—an appliance or device for a particular purpose armature latch—a moveable component of a circuit breaker that releasably fastens and/or holds the operating mechanism of the circuit breaker.

arrange—to dispose in a particular order.

between—in or through the position or interval separating; intermediate to.

biased—urged in a direction.

bi-metal element—a component adapted to be located in the conducting path of the circuit breaker, and adapted to, in response to the flow therethrough of a current of a predetermined approximate amplitude for a predetermined approximate time, generate heat, deflect in response to the heat, and thereby cause the circuit breaker to trip.

can—is capable of, in at least some embodiments.

central—situated at, in, or near the center of a length.

characterizable—describable.

circuit breaker—a device adapted to automatically open, and manually close, an alternating current electrical circuit.
comprising—including but not limited to.
conductor—a component of a circuit breaker adapted to conduct a large majority of electrical current carried by the circuit breaker.
connect—to join or fasten together.
connect—to physically link.
contact arm—a member comprising one of a pair of electrical contacts engageable to close a circuit.
couple—to join, connect, and/or link together.
coupleable—capable of being joined, connected, and/or linked together.
define—to establish the outline, form, or structure of.
device—a machine, manufacture, and/or collection thereof.
electric circuit—a system of electrically-connected electrical devices, the system providing a path for electrical energy to flow, i.e., a current path.
electro-magnetically—via production and/or detection of the generation of a magnetic field.
elongated—drawn out, made spatially longer, and/or having more length than width.
end—an extremity of something that has length; a terminus.
engage—to contact, cause to contact, interact, and/or cause to interact.
flexible—capable of being bent or flexed; pliable.
handle—a manually operable lever for setting and/or resetting a position and/or status of a circuit breaker.
integral—formed or united into another entity.
latch—to releasably fasten or hold.
line—a geometric figure formed by a point moving along a fixed direction and the reverse direction.
load bus—an electrically-conductive component of a circuit breaker located electrically downstream from the operating mechanism.
location—a place.
magnetic element—a component adapted to be located in and/or adjacent the conducting path of the circuit breaker, and adapted to, in response to a current of a predetermined approximate amplitude for a predetermined approximate time, generate a magnetic field sufficient to substantially move an armature latch and/or a contact arm, thereby causing the circuit breaker to trip.
major—relatively great in size or extent.
may—is allowed to, in at least some embodiments.
mechanism—a device and/or portion thereof.
method—a process, procedure, and/or collection of related activities for accomplishing something.
molded case—an enclosure created by forming a molten thermoplastic.
OFF position—with regard to a circuit breaker, a location and/or configuration associated with an open circuit.
ON position—with regard to a circuit breaker, a location and/or configuration associated with a closed circuit.
operating mechanism—a portion of a circuit breaker that comprises pivoting member moveable between an ON position, an OFF position and a TRIPPED position to selectively engage and disengage operating contacts of the circuit breaker.
parallel—being an equal distance apart everywhere.
planar—flat.
plurality—the state of being plural and/or more than one.
position—to place, orient, and/or arrange.
predetermined—established in advance.
release—to free from something that binds, fastens, or holds back.
reset—to move from a TRIPPED position and/or status to an ON position and/or status.
separate—to set and/or keep apart.
set—a related plurality.
substantially—to a great extent or degree.
surface—the exterior and/or outer boundary of an object.
surrounding—to enclose or confine on all sides.
symmetric—having similarity in size, shape, and relative position of corresponding parts.
system—a collection of mechanisms, devices, data, and/or instructions, the collection designed to perform one or more specific functions.
thermally—via production and/or detection of the production of heat.
trip—to stop a flow of electric energy in an electric circuit by via opening a switch.
TRIPPED position—with regard to a circuit breaker, a location and/or configuration associated with a tripped circuit.
unlatch—to release.
width—a measure in a direction perpendicular to a length and a thickness.
within—inside the limits of.
zone—an area and/or region.

DETAILED DESCRIPTION

A general function of a circuit breaker can be to electrically engage and disengage a selected circuit from an electrical power supply. This function can occur by engaging and disengaging a pair of operating contacts for each phase of the circuit breaker. The circuit breaker can provide protection against persistent overcurrent conditions and/or against very high currents produced by short circuits. One of each pair of the operating contacts can be supported by a pivoting contact arm while the other operating contact can be substantially stationary. The contact arm can be pivoted by an operating mechanism such that the movable contact supported by the contact arm can be engaged and disengaged from the stationary contact.

There can be at least two modes by which the operating mechanism for the circuit breaker can disengage the operating contacts: the circuit breaker operating handle can be used to activate the operating mechanism; or a tripping mechanism, responsive to, for example, unacceptable levels of current carried by the circuit breaker, can be used to activate the operating mechanism. For many circuit breakers, the operating handle can be coupled to the operating mechanism such that when the tripping mechanism activates the operating mechanism to separate the contacts, the operating handle moves to a fault or tripped position.

To engage the operating contacts of the circuit breaker, the circuit breaker operating handle can be used to activate the operating mechanism such that the movable contact(s) engage the stationary contact(s). A motor coupled to the circuit breaker operating handle can also be used to engage or disengage the operating contacts. The motor can be remotely operated.

A typical residential circuit breaker can have a continuous current rating ranging from as low as 50 amps to as high as 50 amps. A typical industrial circuit breaker can have a continuous current rating ranging from as low as 15 amps to as high as 160 amps. The tripping mechanism for the breaker can comprise a thermal overload release and a magnetic short circuit release. The thermal overload release can operate by means of a bi-metalic element, in which current flowing through the conducting path of a circuit breaker can generate heat in the bi-metal element, which can cause the bi-metal to deflect and trip the breaker. The heat generated in the bi-metal is typically a function of the amount of current flowing through the bi-metal as well as the period of time that current is flowing. For a given range of current ratings, the bi-metal cross-section and related elements can be specifically selected for such current range resulting in a number of different circuit breakers for each current range.

In the event of current levels above the normal operating level of the thermal overload release, it can be desirable to trip the breaker without any intentional delay, as in the case of a short circuit in the protected circuit, therefore, an electromagnetic trip element is frequently used. In a short circuit condition, the higher amount of current flowing through the circuit breaker can activate a magnetic release that can trip the breaker in a much faster time than typically occurs with the bi-metal heating. It can be desirable to tune the magnetic trip elements so that the magnetic trip unit trips at lower short circuit currents at a lower continuous current rating and trips at a higher short circuit current at a higher continuous current rating. This can match the current tripping performance of the breaker with the typical equipment present downstream of the breaker on the load side of the circuit breaker.

There can be numerous methods to tune the magnetic trip unit for different trip currents. First, the armature spring force can be varied, by an adjustment or by changing springs, to change the resisting force on the armature, which can change the current required to trip the breaker. Second, the cross section of the steel in either the yoke, armature, or both can be adjusted to increase or decrease the amount of magnetic flux created by the short circuit current.

Certain exemplary embodiments comprise a device comprising: a trip mechanism adapted to engage an operating mechanism of an alternating current circuit breaker, said trip mechanism comprising: a bi-metal element arranged lengthwise into a first end zone, a central zone, and a second end zone, a load bus coupled to said first zone, said second end zone adapted to engage an armature latch that is adapted to trip on operating mechanism of the circuit breaker; and an electromagnetic element coupled to the load bus.

FIG. 1 is a perspective view of an exemplary embodiment of an alternating current circuit breaker 1000 in a TRIPPED position. Circuit breaker 1000 can be thermally and/or electro-magnetically actuated and/or tripped. Circuit breaker 1000 can comprise a molded case and/or a body 1100 that can substantially contain and or surround most of the components of circuit breaker 1000. Via its position with respect to body 1100, a handle 1200 can visually indicate a status of circuit breaker 1000, such as ON, TRIPPED, and/or OFF, etc. Handle 1200 can be moved into the TRIPPED position automatically by operation of various components of circuit breaker 1000. Handle 1200 can be moved into the ON, TRIPPED, and OFF positions manually. As shown, handle 1200 is in the TRIPPED position. Circuit breaker 1000 can comprise a ground fault reset test button 1300, the manual actuation of which can trip circuit breaker 1000, an electronic trip device (not shown), and/or handle 1200 from an ON position to a TRIPPED position. To reset circuit breaker 1000, handle 1200 can be moved from the TRIPPED position to the OFF position, and then to the ON position.

Figure 2:
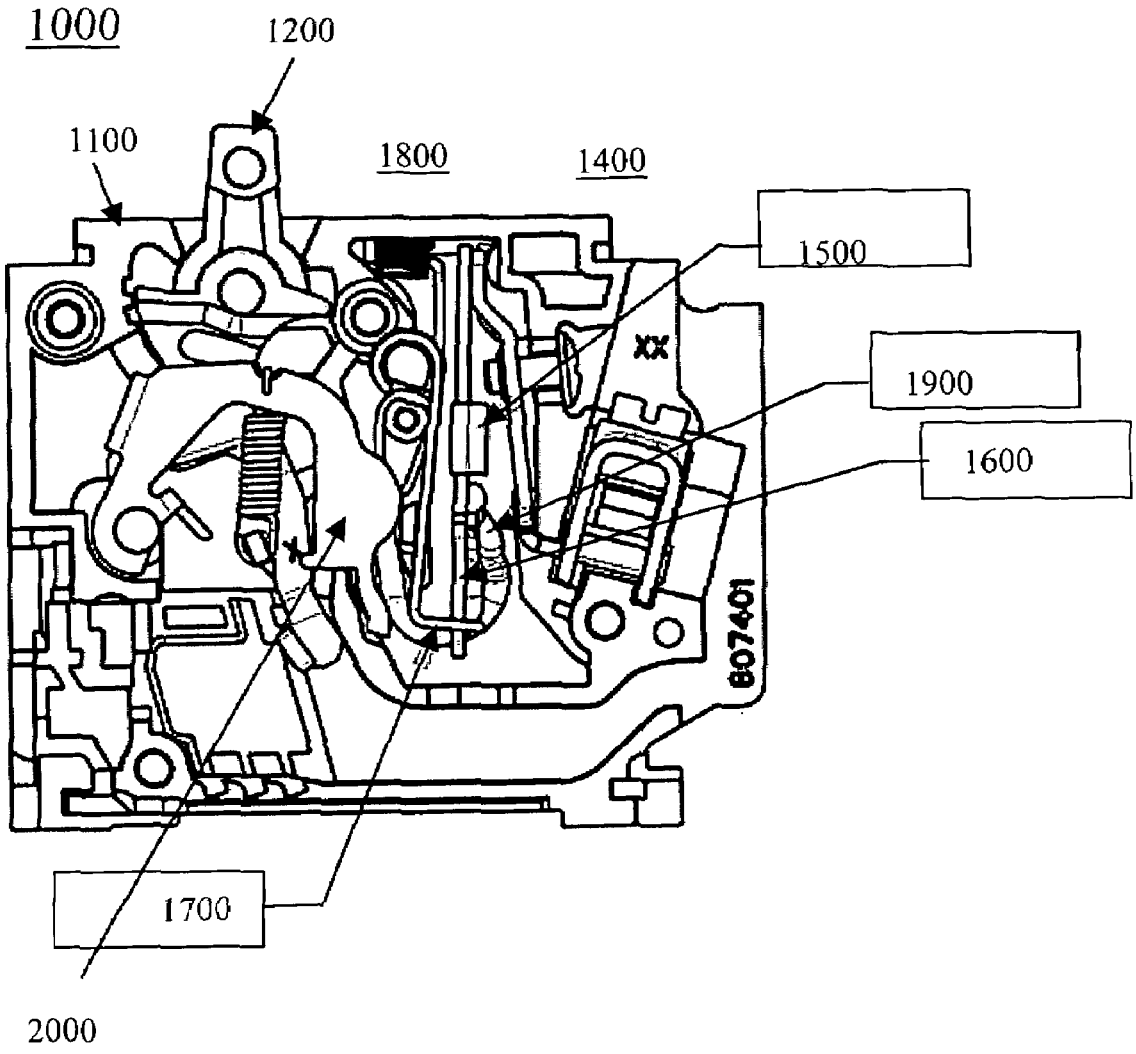
FIG. 2 is a section view of an exemplary embodiment of system 2000 taken along line A-A of FIG. 1.
Figure 3:
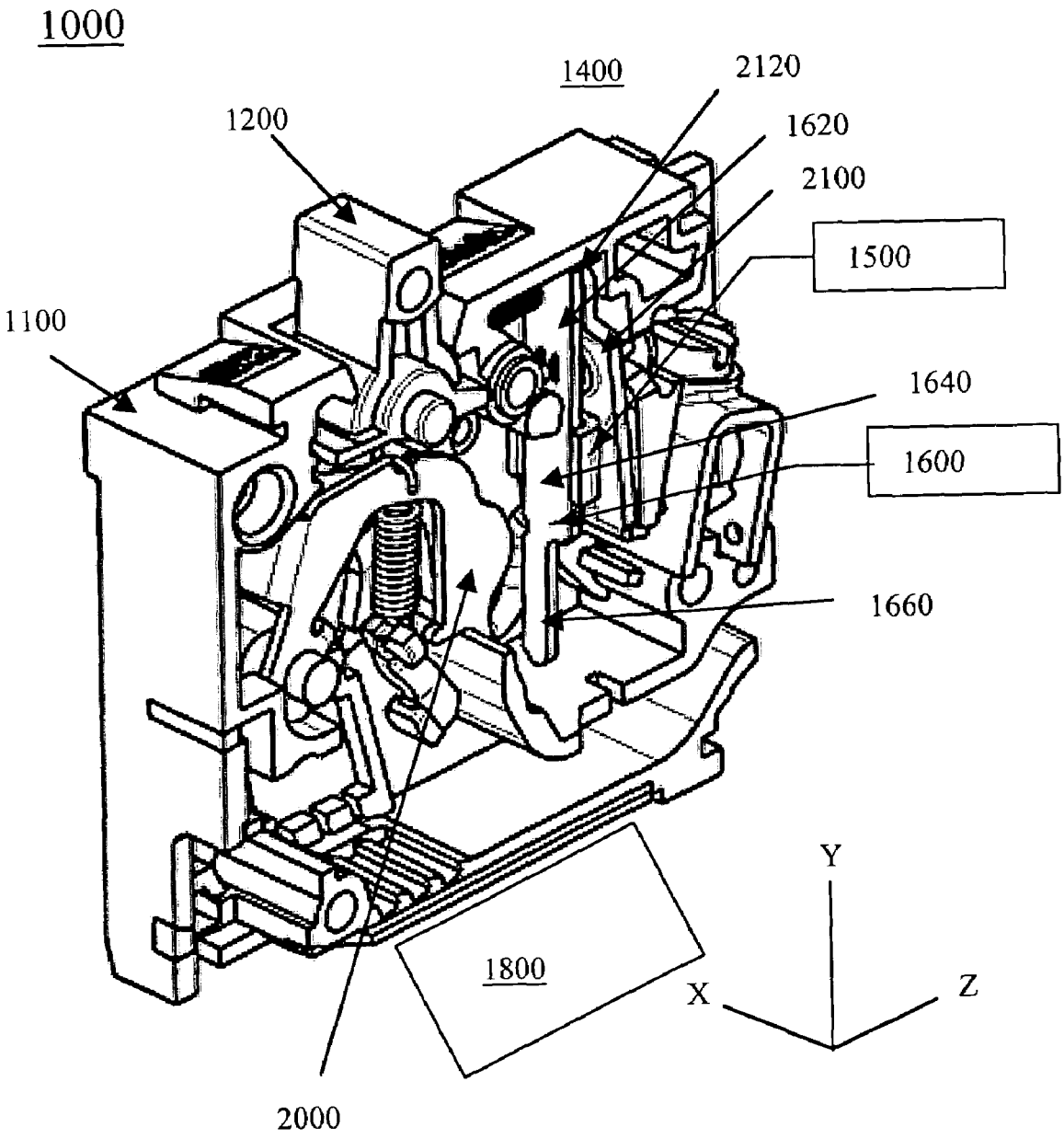
FIG. 3 is a section view of an exemplary embodiment of system 1000 taken along line A-A of FIG. 1.

FIGS. 2 and 3 are section views of an exemplary embodiment of circuit breaker 1000 taken along line A-A of FIG. 1. Shown offset from circuit breaker 1000 in FIG. 3 is the general orientation of its XYZ coordinate system.

Substantially contained within body 1100 can be a trip mechanism 1400, which can comprise an electromagnetic element 1500 that can be magnetically, electrically, and/or mechanically coupled to a load bus 2100. Magnetic element 1500 can at least partially surround and/or be positioned substantially adjacent to a central zone of an elongated substantially planar bi-metal element 1600, which can also be electrically connected to load bus 2100 at location 2120. From the perspective of location 2120, and as perceived along the length of bi-metal element 1600 and/or along Y coordinate axis, bi-metal element 1600 can comprise a proximal end zone 1620, a central zone 1640, and a distal end zone 1660. Notably, distal end zone 1660 can be thinner, as measured along the X coordinate axis, than proximal end zone 1620 and central zone 1640. Also, distal end zone 1660 of bi-metal element 1600 can mechanically engage an armature latch 1700 (not shown in FIG. 3) that is adapted to trip an operating mechanism 1800 of circuit breaker 1000. A flexible conductor 1900 (not shown in FIG. 3) can electrically connect a contact arm 2000 to a location within central zone 1640 of bi-metal element 1600 and between electromagnetic element 1500 and distal end zone 1660 of bi-metal element 1600.

Figure 4:
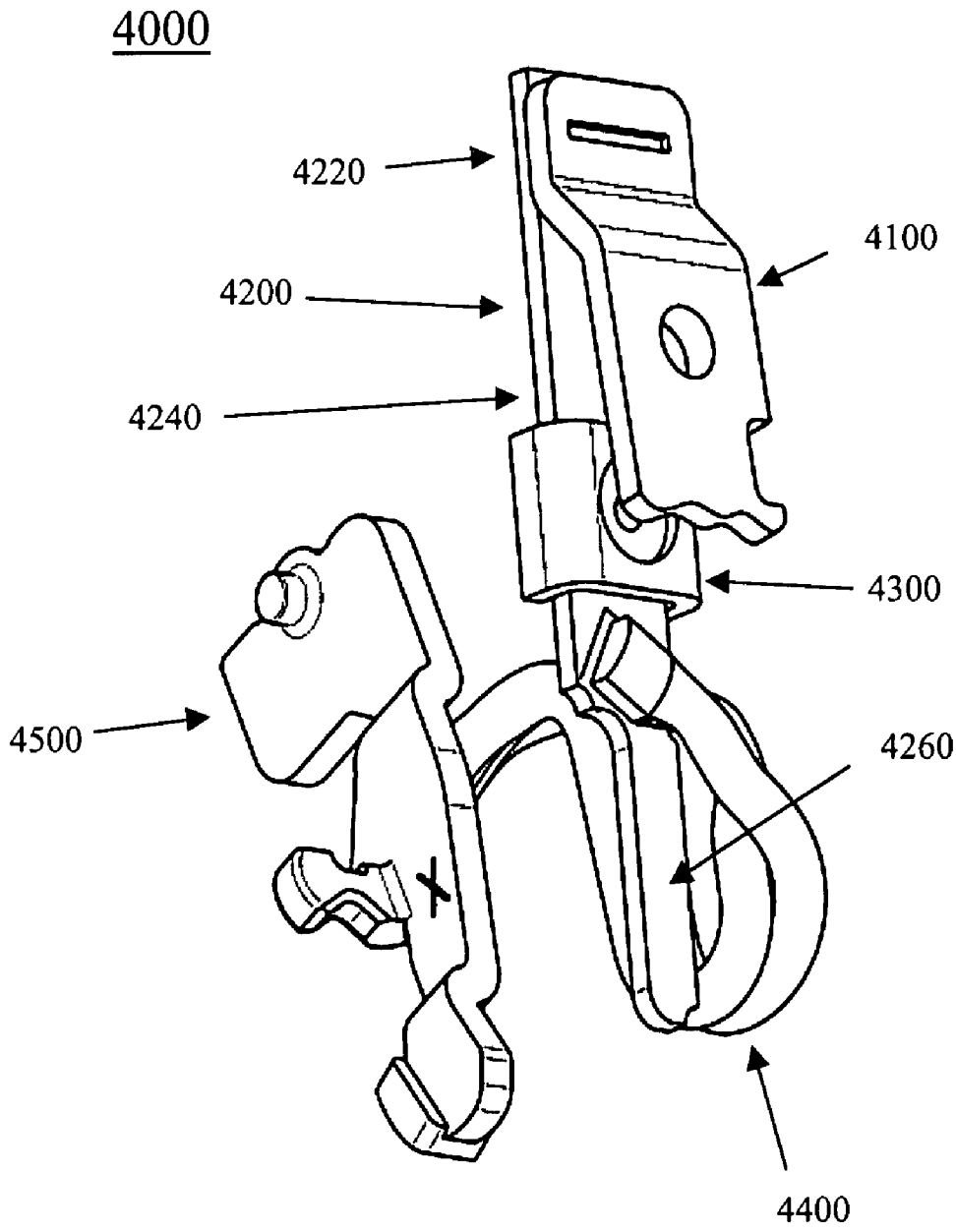
FIG. 4 is a perspective view of an exemplary embodiment of system 4000.

FIG. 4 is a perspective view of an exemplary embodiment of system 4000, which can comprise a load bus 4100, which can be mechanically and/or electrically connected to a proximal end 4220 of a bi-metal element 4200. Load bus 4100 can be magnetically, electrically, and/or mechanically coupled to an electromagnetic element 4300, which can at least partially surround and/or be positioned substantially adjacent to a central zone 4240 of bi-metal element 4200. A flexible conductor 4400 can electrically connect a contact arm 4500 to a location within central zone 4240 of bi-metal element 4200 and between electromagnetic element 4300 and distal end zone 4260 of bi-metal element 4200. Note that distal end zone 4260 can be located substantially outside of a current path that connects load bus 4100 through bi-metal element 4200 and to flexible conductor 4400.

Figure 5:
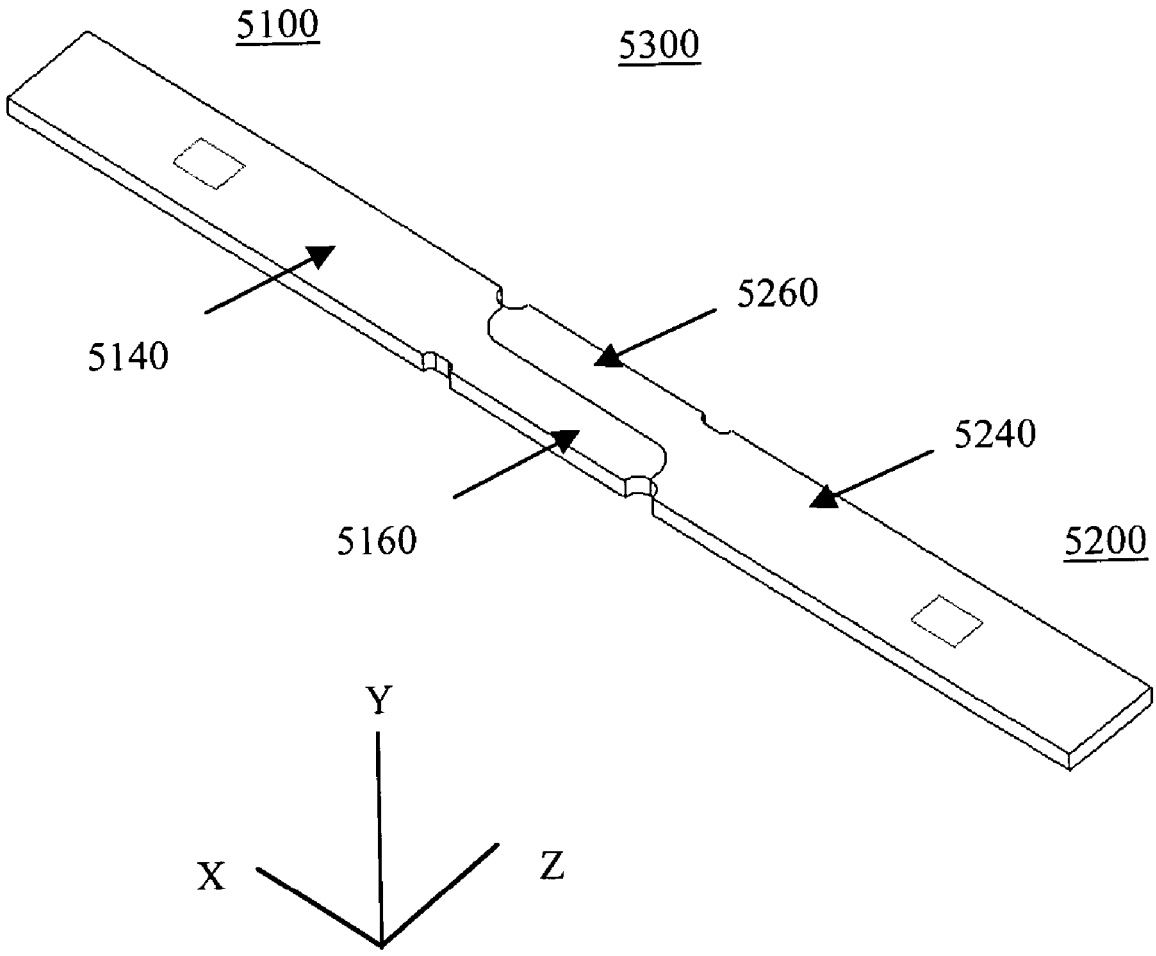
FIG. 5 is a perspective view of an exemplary embodiment of system 5000.

FIG. 5 is a perspective view of an exemplary embodiment of system 5000, which can comprise a pair of substantially identical bi-metal elements 5100, 5200 that can be formed from a single bar 5300. Bi-metal element 5100 can define a central zone 5140 and an end zone 5160. Bi-metal element 5200 can define a central zone 5240 and an end zone 5260. Shown offset from bar 5300 is the general orientation of its XYZ coordinate system. Note that:

1) bi-metal element 5200 can be perceived as having been rotated 180 degrees about the Y coordinate axis with respect to bi-metal element 5100;
2) end zone 5160 need not be symmetric with respect to the X coordinate axis and/or about a line bisecting a width of central zone 5140 and/or bi-metal element 5100;
3) end zone 5260 need not be symmetric with respect to the X coordinate axis and/or about a line bisecting a width of central zone 5240 and/or bi-metal element 5200;
4) end zones 5160 and 5260 can be perceived as overlapping with respect to the X coordinate axis;
5) a width of end zone 5160 and/or end zone 5260 can range from approximately 25 percent to approximately 75 percent, including all values therebetween (such as approximately 30.1, 39.98, 50, 60, and/or 74.731 percent) and all sub-ranges therebetween (e.g., at least 30 percent; from approximately 45 percent to approximately 55 percent; no greater than 60 percent; etc.), of a width of bi-metal element 5100, central zone 5140, bi-metal element 5200, central zone 5240, and/or bar 5300; and 6) the combined widths of end zones 5160 and 5260, measured along the Z coordinate axis, can approximate a width of bi-metal element 5100, central zone 5140, bi-metal element 5200, central zone 5240, and/or bar 5300.

The configuration of the end zones 5160 and 5260 and/or bi-metal elements 5100 and 5200 on bar 5300 can allow for:

1) forming and/or stamping of bi-metal elements 5100 and 5200 with minimal wasted material;
2) locating end zones 5160 and 5260 outside the current path without reducing the cross-sectional area of the current carrying portion of bi-metal elements 5160 and 5260;
3) indirect heating of end zones 5160 and 5260;
4) providing and/or increasing flexibility of end zones 5160 and 5260 and/or bi-metal elements 5100 and 5200; and/or
5) easier routing of the flexible connector (shown in FIG. 4).

Still other embodiments will become readily apparent to those skilled in this art from reading the above-recited detailed description and drawings of certain exemplary embodiments. It should be understood that numerous variations, modifications, and additional embodiments are possible, and accordingly, all such variations, modifications, and embodiments are to be regarded as being within the spirit and scope of this application. For example, regardless of the content of any portion (e.g., title, field, background, summary, abstract, drawing figure, etc.) of this application, unless clearly specified to the contrary, such as via an explicit definition, there is no requirement for the inclusion in any claim herein (or of any claim of any application claiming priority hereto) of any particular described or illustrated characteristic, function, activity, or element, any particular sequence of activities, or any particular interrelationship of elements. Moreover, any activity can be repeated, any activity can be performed by multiple entities, and/or any element can be duplicated. Further, any activity or element can be excluded, the sequence of activities can vary, and/or the interrelationship of elements can vary. Accordingly, the descriptions and drawings are to be regarded as illustrative in nature, and not as restrictive. Moreover, when any number or range is described herein, unless clearly stated otherwise, that number or range is approximate. When any range is described herein, unless clearly stated otherwise, that range includes all values therein and all subranges therein. Any information in any material (e.g., a United States patent, United States patent application, book, article, etc.) that has been incorporated by reference herein, is only incorporated by reference to the extent that no conflict exists between such information and the other statements and drawings set forth herein. In the event of such conflict, including a conflict that would render invalid any claim herein or seeking priority hereto, then any such conflicting information in such incorporated by reference material is specifically not incorporated by reference herein.

What is claimed is:

1. A device comprising:

a trip mechanism adapted to unlatch an operating mechanism of a thermally and electro-magnetically tripped, molded case, alternating current circuit breaker, said trip mechanism comprising:

a contact arm;

an elongated substantially planar bi-metal element comprising a first major surface arranged as a first end zone, a central zone, and a second end zone, said central zone separating said first end zone from said second end zone, said first end zone of said bi-metal element adapted to be coupled to a load bus, said second end zone of said bi-metal element having a width of no more than 60 percent of a width of said central zone of said bi-metal element, said second end zone adapted to directly engage an armature latch without any component of said circuit breaker located between said second end zone and said armature latch, said armature latch adapted to trip said operating mechanism of the circuit breaker;

a magnetic element coupled to the load bus, said magnetic element at least partially surrounding and positioned substantially adjacent said central zone of said bi-metal element; and a flexible conductor connected to said contact arm and said bi-metal element said conductor connected to said bi-metal element at a location within said central zone of said bi-metal element and between said magnetic element and said second end zone of said bi-metal element.

2. A device comprising:

a trip mechanism adapted to engage an operating mechanism of an alternating current circuit breaker, said trip mechanism comprising:

an elongated substantially planar bi-metal element characterizable by a length and a width, said bi-metal element arranged lengthwise into a first end zone, a central zone, and a second end zone, a load bus coupled to said first zone, said second end zone having a width of no more than 60 percent of a width of said central zone, said second end zone adapted to directly engage an armature latch without any component of said circuit breaker located between said second end zone and said armature latch, said armature latch adapted to trip said operating mechanism of the circuit breaker; and an electromagnetic element coupled to the load bus and positioned substantially adjacent said central zone of said bi-metal element.

3. The device of claim 2, further comprising a contact arm electrically coupled to said bi-metal element.

4. The device of claim 2, further comprising a conductor coupling a contact arm and said bi-metal element.

5. The device of claim 2, further comprising a flexible conductor coupling a contact arm and said bi-metal element.

6. The device of claim 2, further comprising a conductor coupling a contact arm and said bi-metal element, said conductor connected to said bi-metal element at approximately said central zone of said bi-metal element.

7. The device of claim 2, further comprising a conductor coupling a contact arm and said bi-metal element, said conductor connected to said bi-metal element at a location within said central zone of said bi-metal element and between said electromagnetic element and said second end zone.

8. The device of claim 2, further comprising a conductor connected to said bi-metal element at a location within said central zone of said bi-metal element and between said electromagnetic element and said second end zone.

9. The device of claim 2, further comprising a conductor connected to said bi-metal element at a location between said electromagnetic element and said second end zone.

10. The device of claim 2, further comprising said load bus.

11. The device of claim 2, further comprising said armature latch.

12. The device of claim 2, wherein said circuit breaker is a molded case circuit breaker.

13. The device of claim 2, wherein said second end zone is not symmetric about a line defined bisecting the width of said central zone of said bi-metal element and parallel to the length of said bi-metal element.

14. The device of claim 2, wherein said second end zone is located substantially to one side of a line defined bisecting the width of said central zone of said bi-metal element and parallel to the length of said bi-metal element.

15. The device of claim 2, wherein a width of said first end zone approximately equals the width of said central zone.

16. The device of claim 2, wherein said second end zone is located substantially outside of a current path of said bi-metal element, said second end zone not directly connected to any flexible conductor, said second end zone only heated indirectly by electrical current flowing via said bi-metal element.

17. The device of claim 2, wherein said electromagnetic element at least partially surrounds said central zone.

18. The device of claim 2, wherein said magnetic element is connected to said central zone.

19. The device of claim 2, wherein said trip mechanism is adapted to be electro-magnetically actuated and thermally actuated.

20. A molded case alternating current circuit breaker comprising:

a trip mechanism adapted to engage an operating mechanism of said circuit breaker, said trip mechanism comprising:

an elongated substantially planar bi-metal element characterizable by a length and a width, said bi-metal element divided lengthwise into a first end zone, a central zone, and a second end zone, a load bus coupled to said first zone, said second end zone having a width of no more than 60 percent of a width of said central zone, said second end zone adapted to directly engage an armature latch without any component of said circuit breaker located between said second end zone and said armature latch, said armature latch adapted to trip said operating mechanism of said circuit breaker; and an electromagnetic element coupled to the load bus and positioned substantially adjacent said central zone of said bi-metal element.

* * * * *